US010145163B2

(12) United States Patent
Choi

(10) Patent No.: US 10,145,163 B2
(45) Date of Patent: Dec. 4, 2018

(54) HOME APPLIANCE HAVING MOVABLE HANDLE

(71) Applicant: LG ELECTRONICS INC., Seoul (KR)

(72) Inventor: Moonho Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 39 days.

(21) Appl. No.: 15/152,640

(22) Filed: May 12, 2016

(65) Prior Publication Data

US 2016/0333624 A1 Nov. 17, 2016

(30) Foreign Application Priority Data

May 12, 2015 (KR) ..... 10-2015-0065862

(51) Int. Cl.

| | |
|---|---|
| ***F24C 15/02*** | (2006.01) |
| ***A47L 15/42*** | (2006.01) |
| ***F25D 23/02*** | (2006.01) |
| ***E05F 11/54*** | (2006.01) |
| ***E05D 13/00*** | (2006.01) |

(Continued)

(52) U.S. Cl.

CPC ..... *E05F 11/54* (2013.01); *A47L 15/4259* (2013.01); *D06F 39/14* (2013.01); *D06F 58/20* (2013.01); *E05D 13/1207* (2013.01); *F24C 15/023* (2013.01); *F24C 15/024* (2013.01)

(58) Field of Classification Search

CPC ..... A47L 15/4529; A47B 95/02; E05F 11/52; E05F 11/54; F25D 23/028; F24C 15/023; F24C 15/024

See application file for complete search history.

(56) References Cited

U.S. PATENT DOCUMENTS 3,075,735 A * 1/1963 Skinner ..... A47B 95/02 16/430
4,412,710 A * 11/1983 Laprad ..... A47L 15/4259 312/292

(Continued)

FOREIGN PATENT DOCUMENTS

| | | |
|---|---|---|
| EP | 1702550 | 9/2006 |
| EP | 2581666 | 4/2013 |

(Continued)

OTHER PUBLICATIONS

Extended European Search Report issued in European Application No. 16167874.3 dated Sep. 23, 2016, 8 pages.

*Primary Examiner* — Kimberley S Wright
(74) *Attorney, Agent, or Firm* — Fish & Richardson P.C.

(57) ABSTRACT

A home appliance includes a cabinet. The home appliance further includes a door that defines a penetration hole that is located in a front surface of the door. The home appliance further includes a handle. The home appliance further includes a handle link that is configured to rotate about a handle link rotating shaft that is located inside the door, wherein a portion of the handle link is exposed outside the door through the penetration hole and a length of the portion of the handle link varies based on an opening angle of the door. The home appliance further includes a link that is configured to convert a rotation motion of the door into a rotation of the handle link and that is configured to guide rotation of the door based on the handle link being restrained by having a variable length.

16 Claims, 10 Drawing Sheets

(51) Int. Cl.
*D06F 39/14* (2006.01)
*D06F 58/20* (2006.01)

(56) References Cited

U.S. PATENT DOCUMENTS 4,726,352 A * 2/1988 Radke ..... F24C 15/026 126/190
5,881,710 A * 3/1999 Davis ..... F24C 15/023 126/194
7,036,499 B2 * 5/2006 Bartmann ..... E05B 7/00 126/191
7,216,402 B2 * 5/2007 Nishiyama ..... E05B 85/12 16/412
7,445,005 B2 * 11/2008 Bartmann ..... E05B 7/00 126/192
7,793,388 B2 * 9/2010 Wing ..... E05B 1/0015 16/412
7,913,361 B2 * 3/2011 Tomiji ..... E05B 85/12 16/412
8,020,548 B2 * 9/2011 Bartmann ..... F24C 15/023 126/192
8,490,616 B2 * 7/2013 Venezia ..... F24C 15/024 126/190
8,517,480 B2 * 8/2013 Kose ..... A47B 95/02 312/228
9,138,056 B2 * 9/2015 Kwon ..... A47B 95/02
9,291,353 B2 * 3/2016 Saporetti ..... F24C 15/024
9,297,572 B2 * 3/2016 Bischoff ..... F25D 23/028
9,322,592 B2 * 4/2016 Kim ..... F25D 23/04
9,435,545 B2 * 9/2016 Chin ..... F24C 15/023
9,580,952 B2 * 2/2017 Da Pont ..... A47L 15/4259
9,625,160 B2 * 4/2017 Xiao ..... F24C 15/023
9,625,204 B2 * 4/2017 Kim ..... F25D 23/04
9,642,511 B2 * 5/2017 Shoup ..... A47L 15/4261
9,777,523 B2 * 10/2017 Choi ..... E05D 15/04
9,888,828 B2 * 2/2018 Lagness ..... A47L 15/4261
9,897,368 B2 * 2/2018 Lee ..... F25D 23/028
2005/0022802 A1 * 2/2005 Bartmann ..... E05B 7/00 126/194
2005/0023946 A1 * 2/2005 Bartmann ..... F24C 15/023 312/328
2005/0251959 A1 * 11/2005 Nishiyama ..... E05B 85/12 16/110.1
2012/0111366 A1 * 5/2012 Baldwin ..... A47L 15/4293 134/18
2012/0280608 A1 * 11/2012 Park ..... E05B 1/0015 312/405
2014/0035453 A1 * 2/2014 Kwon ..... A47B 95/02 312/325
2016/0076289 A1 * 3/2016 Choi ..... E05D 15/04 312/326
2016/0091209 A1 * 3/2016 Jung ..... F24C 15/024 219/394
2016/0169529 A1 * 6/2016 Deng ..... F24C 15/023 126/191
2016/0273777 A1 * 9/2016 Kim ..... F24C 15/023
2016/0334114 A1 * 11/2016 Choi ..... F24C 15/168
2016/0356503 A1 * 12/2016 Binda ..... F24C 15/021
2017/0023259 A1 * 1/2017 Di Tommaso ..... F24C 15/023
2017/0108228 A1 * 4/2017 Park ..... F24C 15/024
2017/0278359 A1 * 9/2017 Kim ..... G07F 19/205

FOREIGN PATENT DOCUMENTS

KR 20-0189533 7/2000
KR 10-2006-0110812 10/2006
KR 10-0803840 2/2008
KR 10-2014-0018565 2/2014
KR 10-2014-0083341 7/2014

* cited by examiner

HOME APPLIANCE HAVING MOVABLE HANDLE

CROSS REFERENCE TO RELATED APPLICATION

This application claims the benefit of Korean Patent Application No. 10-2015-0065862, May 12, 2015, which is hereby incorporated by reference as if fully set forth herein.

FIELD

This application relates to a home appliance that includes a door.

BACKGROUND

Home appliances may refer to products that perform a variety of functions using electricity or other energy at home or indoors.

Examples of home appliances may include a washing apparatus for washing or drying laundry, a refrigerator for keeping food at a refrigerating or freezing temperature, a dishwasher for washing dishes, and gas or electric ovens or microwave ovens for cooking food. Of course, in addition to the aforementioned examples, various other types of home appliances may be present.

In many cases, home appliances may include a cabinet defining the external appearance of the home appliance. In turn, a chamber in which an object is received may be defined in the cabinet. Thus, the cabinet may define the chamber.

For example, the chamber may be configured into various shapes according to the types or purposes thereof, such as a space for cooking food, a space for washing laundry, a space for storage or processing of clothes, a space for washing dishes, or a space for storage of food. Of course, the chamber may be referred to by various names according to the purposes or usages of home appliances.

The home appliances may include a door configured to be opened or closed for the introduction or removal of an object. The door may be provided with a handle to assist a user in opening or closing the door by gripping the handle with the hand. e.g.

SUMMARY

According to an innovative aspect of the subject matter described in this application, a home appliance includes a cabinet that defines a chamber that is configured to receive an object; a door that is located at a front side of the cabinet, that is configured to open or close the chamber by rotating about a door rotating shaft, and that defines a penetration hole that is located in a front surface of the door; a handle that is located on the front surface of the door and that is configured to be gripped by a user during opening or closing the door; a handle link that is configured to rotate about a handle link rotating shaft that is located inside the door, wherein a portion of the handle link is exposed outside the door through the penetration hole and a length of the portion of the handle link varies based on an opening angle of the door; and a link that is configured to convert a rotation motion of the door into a rotation of the handle link and that is configured to guide rotation of the door based on the handle link being restrained by having a variable length.

The home appliance may include one or more of the following optional features. The link is configured to rotate about a link rotating shaft based on the door rotating. The link rotating shaft is located eccentrically to the door rotating shaft. An end of the link is rotatably connected to the handle link. The link includes a link elastic member that is configured to guide rotation of the door by a length that the elastic member is configured to extend based on rotation of the handle link being restrained. The link includes a link rod that is connected to the handle link and includes a damper rod that is rotatably connected to the link rotating shaft. The link elastic member is located between the link rod and the damper rod. The home appliance further includes a screen that is located inside the penetration hole and that is configured to move upward or downward while being in contact with the handle link during rotation of the handle link. The link is configured to elastically support the screen. The screen includes a screen body that is configured to cover a gap between the penetration hole and the handle link; a roller that is configured to contact a lower surface of the handle link on a top of the screen body by rotating; and a screen elastic member that is configured to elastically support the screen body from the link. The handle includes a handle grip portion that extends in a left-right direction and that is spaced apart from the front surface of the door; and a handle support portion that extends from opposite ends of the handle grip portion toward the door. The handle support portion and the handle link are coupled to each other. A damper is located between the handle support portion and the link. The damper includes a damper housing, wherein the handle support portion is configured to receive the damper housing; and a damper shaft that extends from the damper housing, where the link is configured to support the damper shaft. The handle support portion includes a decoration portion that is configured to contact the door and that includes a rubber pad. The rubber pad includes a lower end that is coupled to a lower end of the decoration portion.

According to another innovative aspect of the subject matter described in this application, a home appliance includes a cabinet that defines a chamber that is configured to receive an object; a door that is configured to open or close the chamber by rotating about a door rotating shaft and that defines a penetration hole that is located in a front surface of the door; a handle that is located on the front surface of the door and that is configured to be gripped by a user during opening or closing the door; a handle link that is configured to rotate about a handle link rotating shaft that is located inside the door, wherein a portion of the handle link is exposed outside the door through the penetration hole and a length of the portion of the handle link varies based on an opening angle of the door; and a link that is configured to convert a rotation motion of the door into a rotation motion of the handle link and that includes a link elastic member that is configured to stretch in a direction in which the rotation motion of the door or the rotation motion of the handle link is limited based on the rotation motion of the door or the rotation motion of the handle link being stationary.

The home appliance may include one or more of the following optional features. A length of the link is variable based on the elastic member being configured to stretch in a longitudinal direction of the elastic member.

According to another innovative aspect of the subject matter described in this application, a home appliance includes a cabinet that defines a chamber that is configured to receive an object; a door that is configured to open or close the chamber by rotating about a door rotating shaft and that defines a penetration hole that is located in a front surface of the door; a handle that is located on the front surface of the door and that is configured to be gripped by a user during opening or closing the door; a handle link that is configured to rotate about a handle link rotating shaft that is located inside the door, wherein a portion of the handle link is exposed outside the door through the penetration hole and a length of the portion of the handle link varies based on an opening angle of the door; a link that is configured to convert a rotation motion of the door into a rotation motion of the handle link; and a screen that is located inside the penetration hole and that is configured to move upward or downward while being in contact with the handle link during rotation of the handle link.

The home appliance may include one or more of the following optional features. The link is configured to elastically support the screen. The screen includes a screen body that is configured to cover a gap between the penetration hole and the handle link; a roller that is configured to contact a lower surface of the handle link on a top of the screen body by rotating; and a screen elastic member that is configured to elastically support the screen body from the link. The screen is configured to contact a lower portion of the handle link. The screen is configured to block a gap defined by the penetration hole and the handle link based on the screen moving up or down in response to rotation of the handle, wherein a size of the gap varies as the handle link rotates.

An object of the subject matter described in this application is to provide a home appliance having a handle assembly that may limit the linkage between a door and a handle when the rotation of the door and the handle is restrained.

An object of the subject matter described in this application is to provide a home appliance that may prevent damage to the user's hand that occurs when a door is closed in the state in which the user's hand is jammed between the door and a handle.

An object of the subject matter described in this application is to provide a home appliance that may prevent the user's hand from becoming jammed between a door and a handle.

An object of the subject matter described in this application is to provide a home appliance that may allow a handle to smoothly return to the correct position when a door is closed.

An object of the subject matter described in this application is to provide a home appliance that may implement the linkage between rotation of a door and rotation of a handle, thereby achieving convenience of use and increased safety.

DETAILED DESCRIPTION

Figure 1:
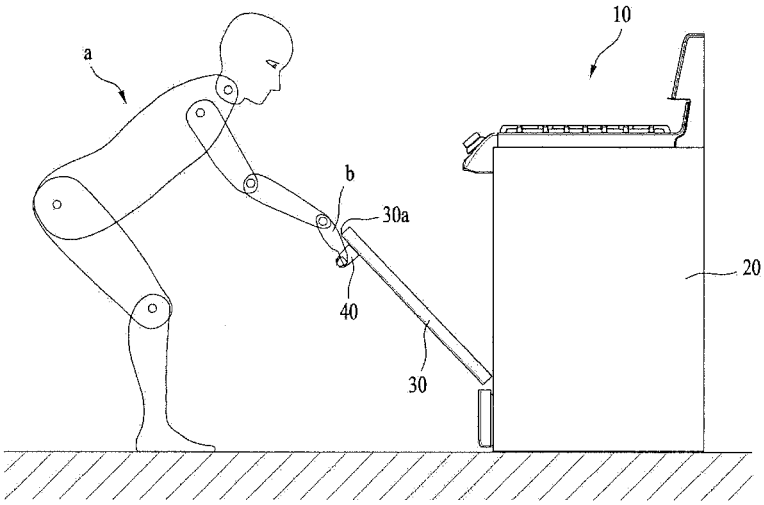
FIG. 1 is a side view of an action of opening an example door of an example home appliance.

FIG. 1 illustrates an example home appliance. In some implementations, in the illustrated oven or dishwasher, a handle 40 is provided near the upper end of the front surface of a door 30, and the door 30 is configured so as to be opened or closed via pivotal rotation thereof about the lower end thereof as a pivot center.

To open or close the door 30, the user has to grip and pull the handle 40 provided on the front surface of the cabinet 20, and simultaneously to apply downward force to the handle 40. This type of door may be referred to as a pull-down type door. Here, the handle 40 is fixed to the door 30.

In some implementations, when opening the door 30, the user "a" will grip the handle 40 with the hand such that the back of the hand "b" faces upward. In some implementations, the wrist of the user may bend as the door 30 is opened, and even the situation in which the back of the hand "b" is pushed by an upper edge 30*a* of the door 30 may occur. Although changing a hand's posture of gripping the handle 40 while the door 30 is being opened may be considered to eliminate this discomfort, this is not easy because may be necessary to change from the hand that has already gripped the handle 40 to the other hand.

In some implementations, it may be contemplated for the user to open the door 30 by gripping the handle 40 with the hand such that the palm faces upward. However, even in this case, similarly, the wrist of the user will be bent and the wrist or the palm may be pushed by the edge 30*a*.

As illustrated in FIG. 1, the handle 40 deviates from the visual field of the user in a state in which the door 30 is rotated and opened to some extent. In particular, in a state in which the door 30 is rotated by 90 degrees and is completely opened, the user may not be able see the handle 40 and the user may not be able to grip the handle 40 when closing the door 30.

In particular, in the case of opening or closing the door using the above-described handle, use of the handle may be difficult because the user must move various joints and muscles, such as the wrist, the arm, the knee, or the shoulder. In addition, since an increase in the capacity of home appliances entails an increase in the size and weight of the door, the difficulty may further increase.

Figure 2:
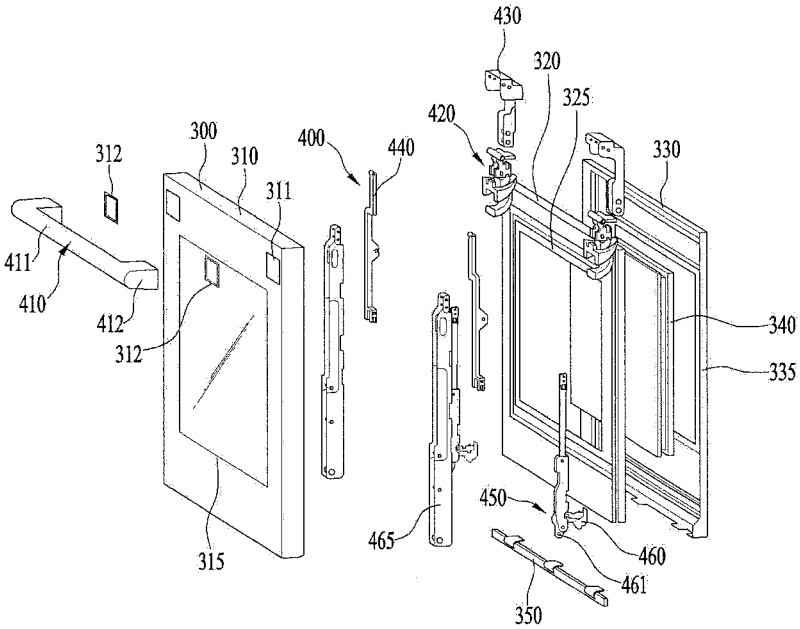
FIG. 2 is an exploded perspective view of an example door of an example home appliance.

FIG. 2 illustrates example components of an example home appliance door. The subject matter described below relate, more particularly, to a door and a handle for opening or closing the door.

A door 300 is connected to the cabinet to open or close a chamber in which an object is received. The door 300 is provided with a handle 410. A user opens or closes the door 300 by gripping the handle 410 with the hand.

The door 300 may be comprised of a plurality of panels. First, the door 300 may include a front panel 310 for defining the front surface of the door 300 and a rear panel 330 for defining the rear surface of the door 300. A prescribed space may be defined between the front panel 310 and the rear panel 330 to receive various components.

An intermediate panel 320 may be provided between the front panel 310 and the rear panel 330. The panels 310, 320 and 330 may be centrally provided with windows 315, 325 and 335 to enable the interior of the chamber to be viewed from the outside. A window panel 340 may be fitted to each window.

As such, the door 30 may be prepared as the front panel 310, the rear panel 330, the intermediate panel 320, and the window panel 340 are coupled to one another. In addition, a shielding panel 350 may be provided at the lower end of the door 300. The shielding panel 350 may define the lower surface of the door 300.

In some implementations, hinge structures (e.g., 460) may be provided inside the door 300 to enable the opening or closing of the door 300. In addition, damper structures (e.g., 450) may be provided to prevent the door 300 from being opened any further in the maximally opened state thereof, or to cause the door 300 to be smoothly opened or closed.

In some implementations, a hinge 460 may be provided at the lower end of the door 300 so as to define a rotating shaft of the door 300. As the hinge 460 is connected to the door 300 and the cabinet, the door 300 is rotatable relative to the cabinet.

The hinge 460 and the damper 450 may be provided on either side of the door 300 to ensure the more stable opening and closing of the door 300.

Some implementations may relate to the door 300, which enables the handle 410 to vary in position as the door 300 is opened or closed, rather than the door which is simply opened or closed via the handle 410, and the home appliance including the door 300. One example of such a home appliance may be an oven.

In some implementations, the rotation of the door 300 may be linked to the rotation of the handle 410 and, to this end, a handle assembly 400 may be provided. However, as will be described below, the linkage between the rotation of the door 300 and the rotation of the handle 410 may be broken when external interference occurs, for example, when the user's hand is jammed in a penetration hole 311.

The handle assembly 400 may include the handle 410 provided on the front surface of the door 300 and a handle link 420 connected to the handle 410.

In some implementations, the handle 410 may include a handle grip portion 411 having a horizontal bar shape, and a handle support portion 412 connected to the handle link 420 on either side of the handle grip portion 411. In some implementations, the user opens or closes the door 300 by gripping the handle grip portion 411 with the hand. However, the opening or closing of the door 300 may be performed in the state in which the user's hand is located on the handle support portion 412. At this time, as the door 300 is closed, an accident in which a portion of the user's hand is jammed in the penetration hole 311 may occur.

As will be described below, it is possible to prevent this hand jamming problem, or to minimize damage to the user's hand when the user's hand is jammed.

The handle link 420 is configured so as to be rotated as the door 300 is rotated. The rotation of the handle link 420 may be converted into the rotation of the handle 410. In other words, the handle link 420 and the handle 410 are integrally rotated with each other. More specifically, the handle grip portion 411, the handle support portion 412, and the handle link 420 are integrally rotated with one another.

The handle link 420 may be located inside the door 300. As the door 300 is rotated, a portion of the handle link 420 may be exposed out of the door 300. That is, the center of rotation of the handle link 420 is located inside the door 300.

That is, the handle link 420 may move to the inside or outside of the door 300 through a penetration hole 311 formed in the front surface of the door 300, more particularly, formed the front panel 310. In other words, the length of the handle link 420, exposed out of the door 300 through the penetration hole 311, increases as the opening angle of the door 300 increases.

A contact member 312 may be provided near the penetration hole 311 in order to protect the penetration hole 311 and to protect the handle link 420 moving through the penetration hole 311. In addition, the handle link 420 and the handle 410 may be coupled to each other in the front or rear of the contact member 312 or in the front or rear of the penetration hole 311. The contact member 312 may be formed of an elastic material so as to alleviate shock and to minimize damage to the user's hand when the user's hand is jammed. In some implementations, the contact member 312 may be formed of a rubber material.

The handle 410 may always be exposed out of the door 300 regardless of the position or opening angle of the door 300, whereas only a portion of the handle link 420 may be exposed out of the door 300 according to the opening angle of the door 300.

A handle link bracket 430 may be provided inside the door 300 and serve to support the handle link 420. The handle link bracket 430 may be fixed inside the door 300. Accordingly, it is possible to prevent force applied to the handle link 420 from being directly transmitted to the door 300. Through the provision of the handle link bracket 430, the handle link 420 is more stably movable relative to the door 300.

The handle assembly 400 may include a link 440 for converting the angle of rotation of the door 300 into the angle of rotation of the handle link 420. Of course, the link 440 may not constitute the handle assembly 400, but may constitute a damper assembly or a hinge assembly having a damper or hinge.

The link 440 is provided inside the door 300 to rotate the handle link 420 as the door 300 is rotated.

Accordingly, it will be appreciated that the rotation of the door 300 may be basically converted into the rotation of the handle 410 and the handle link 420 through the link 440.

From the aspect of jamming of the user's hand, the mechanical linkage between the rotation of the door 300 and the rotation of the handle 410 causes no problem while the door 300 is being opened. However, the mechanical linkage between the rotation of the door 300 and the rotation of the handle 410 may be problematic while the door 300 is being closed. The reason for this is that a larger force may be applied to the user's hand when the door is closed further in the state in which the user's hand is jammed in the penetration hole 311. Therefore, when interference occurs between the rotation of the door 300 and the rotation of the handle link 420 or the handle 410, it may be desirable to break the linkage of rotation. In particular, it may be desirable to break the linkage of rotation while the door 300 is being closed.

Figure 3A:
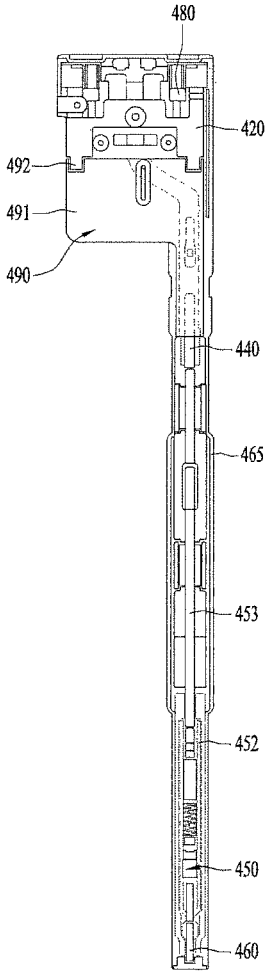
FIG. 3A is a front view of an example handle assembly.
Figure 3B:
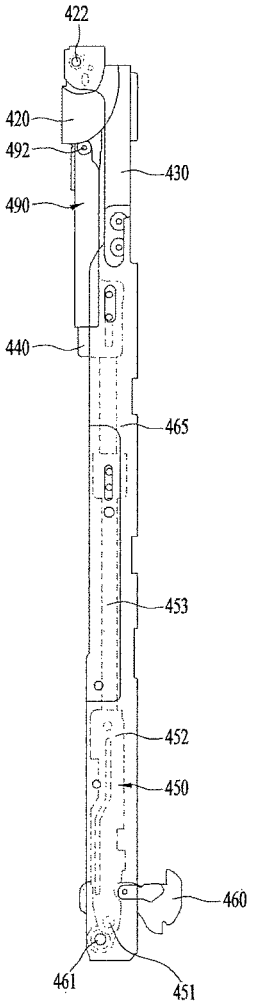
FIG. 3B is a side view of an example handle assembly.

Hereinafter, the handle assembly 400 described above will be described in more detail with reference to FIGS. 3A AND 3B. FIGS. 3A and 3B illustrates an example handle assemblies. Some implementations include a screen for preventing the jam of the user's hand.

The components inside the door 300 as well as the door 300 are connected to the cabinet using the hinge 460. That is, the door 300 and the components inside the door 300 are rotated about a door rotating shaft 461 provided at the hinge 460. In other words, as the door 300 is opened, all components illustrated in FIGS. 3A AND 3B excluding the hinge 460 are rotated about the door rotating shaft 461. The door rotating shaft 461 is formed on the hinge 460.

In some implementations, a hinge housing 465 is rotated about the door rotating shaft 461, and the hinge 460 may be received in a lower region of the hinge housing 465. The hinge housing 465 is connected to the panels of the door 300 so as to be rotated integrally with the panels of the door 300.

In addition, the hinge housing 465 is connected to the handle link bracket 430.

In addition to the hinge 460, the damper 450 may be received within the hinge housing 465. The damper 450 may be rotated about a link rotating shaft 451. The link rotating shaft 451 may be provided at the hinge 460. Here, the link rotating shaft 451 may be referred to as a damper rotating shaft. The door rotating shaft 461 and the link rotating shaft 451 may be formed at different positions on the single hinge 460. Of course, the door rotating shaft 461 and the link rotating shaft 451 may be formed by coupling separate members to each other. Here, as illustrated in FIG. 3B, the door rotating shaft 461 and the link rotating shaft 451 need to be formed at different positions. Due to the eccentric relationship between the door rotating shaft 461 and the link rotating shaft 451, the link 440 may rotate the handle link 420 as the door 300 is rotated about the door rotating shaft 461.

In some implementations, the single hinge or hinge assembly may include different rotating shafts, e.g. the door rotating shaft 461 and the damper rotating shaft (e.g. the link rotating shaft 451).

In some implementations, the link rotating shaft 451 and the door rotating shaft 461 are eccentric to each other. That is, the link rotating shaft 451 and the door rotating shaft 461 do not configure coaxial shafts. When the door 300 is rotated about the door rotating shaft 461, the damper 450 is rotated about the link rotating shaft 451. The difference between the centers of rotation of the door 300 and the damper 450 causes variation in the positional relationship between the damper 450 and the hinge housing 465 as the door 300 is rotated. In other words, the angle between the damper 450 and the hinge housing 465 varies.

With the eccentric relationship between the centers of rotation of the damper 450 and the hinge housing 465, the handle link 420 may be rotated as the door 300 is rotated.

Figure 7:
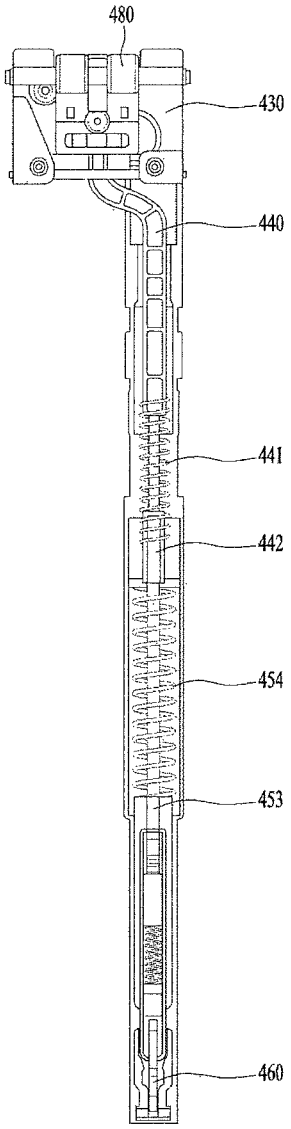
FIG. 7 is a front view of an example handle assembly.

The damper 450 may include a damper housing 452, a damper rod 453, and a damper spring (see reference numeral 454 in FIG. 7). The damper spring may be configured so as to surround the damper rod 453. The damper 450 may be received inside the hinge housing 465.

In some implementations, the damper housing 452 is rotatably connected to the link rotating shaft or the damper rotating shaft 451. The damper housing 452 may also be connected to the damper rod 453.

The damper spring may be located around the damper rod 453 and function to ensure the smooth opening or closing of the door 300.

The damper 450 may implement the damping function because the damper housing 452, the damper rod 453, and the damper spring are rotated about the damper rotating shaft 451. That is, the damping function may be implemented due to the eccentric relationship between the damper rotating shaft (link rotating shaft) 451 and the door rotating shaft 461.

The link 440 may be configured as an extension of the damper rod 453. That is, the link 440 may extend from the damper rod 453 to a link connecting portion 424. In other words, the damper rod 453 and the link 440 are provided between the link connecting portion 424 and the damper rotating shaft (or the link rotating shaft) 451. The damper rod 453 and the link 440 are rotated about the link rotating shaft 451. A combination of the damper rod 453 and the link 440 may be referred to as a link.

The configuration of the damper 450 is well known and, thus, a more detailed description thereof will be omitted hereinafter.

In some implementations, the link 440 is connected to the damper 450 so as to rotate the handle link 420. That is, the link 440 may extend from the damper rod 453 to thereby be connected to the handle link 420. That is, the link 440 may be configured so as to be rotated about the damper rotating shaft 451 using the eccentric relationship between the rotating shaft of the damper 450 and the rotating shaft of the door 300.

In other words, when the door 300 is rotated and opened, the link 440 pulls the handle link 420 to rotate the handle link 420. Since the handle link 420 is coupled to the handle 410, the position of the handle 410 relative to the front surface of the door 300 may be varied by the rotation of the handle link 420.

The handle link 420 is rotated about a handle link rotating shaft 422 provided inside the door 300. Thus, a vertical load may be applied to the handle link rotating shaft 422 through the handle 410 and the handle link 420.

Thereby, great force may be applied to the handle link rotating shaft 422, which may prevent the smooth rotation of the handle link 420.

To solve the problem described above, first, the handle link bracket 430 may be provided to fix the handle link rotating shaft 422. The handle link bracket 430 is fixed inside the door 300, and the handle link rotating shaft 422 may be rotatably coupled to the handle link bracket 430.

The handle link bracket 430 may be connected to the hinge housing 465. That is, the handle link bracket 430 may extend upward from the upper end of the hinge housing 465.

The left-right width of the upper side of the handle link bracket 430 may be greater than the left-right width of the hinge housing 465. That is, the left-right width of the handle link bracket 430 may have a great value at the position thereof to which the handle link rotating shaft 422 is fixed. This serves to increase the left-right width of the handle link rotating shaft 422 and the left-right width of the handle link 420.

A pair of the handle links 420 is provided respectively at the left and right sides of the door 300. In addition, a specific handle link 420 has a greater left-right width than the left-right width of the damper 450. As such, the handle link 420 having enhanced reliability and strength may be provided. In this way, the handle 410 may be more firmly connected to the door 300.

The subject matter described below includes distance maintenance members 480 will be described in detail with reference to FIGS. 4 and 5.

Figure 4:
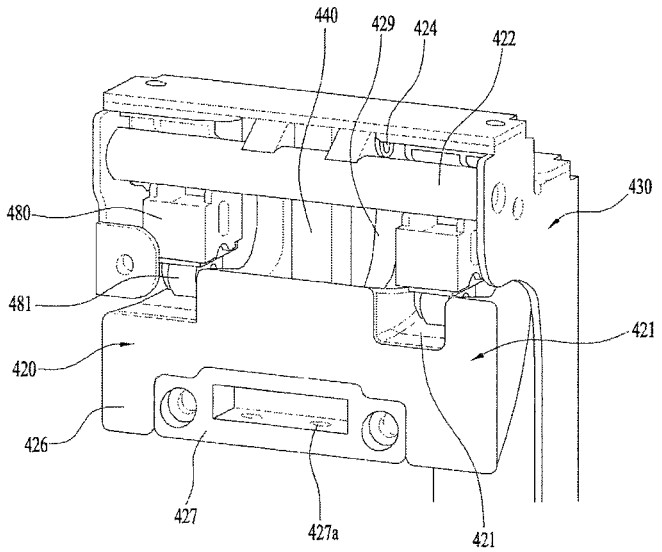
FIG. 4 is a perspective view of an example upper portion of an example handle.

FIG. 4 illustrates an example handle link 420, distance maintenance members 480, link 440, and handle link bracket 430. FIG. 5 illustrates example components of FIG. 4 excluding the handle link bracket 430.

Figure 5:
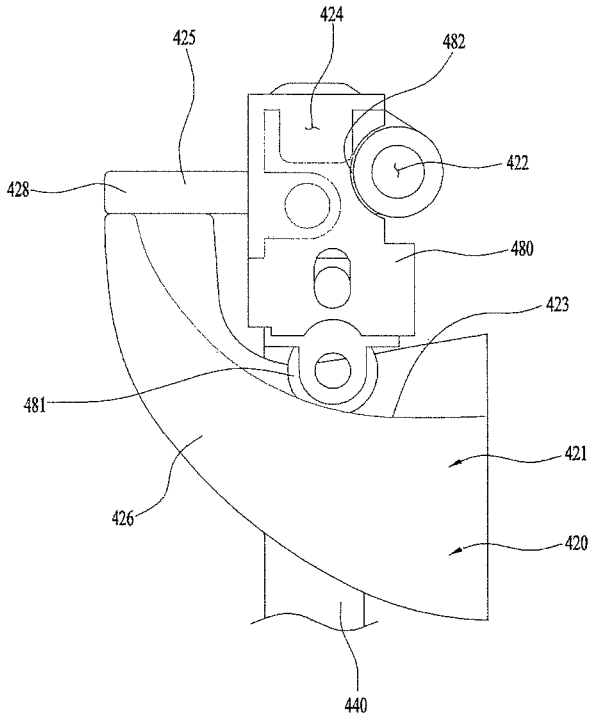
FIG. 5 is a side view of an example handle assembly with a handle link bracket omitted.

As illustrated in FIGS. 4 and 5, the handle link 420 may include the handle link rotating shaft 422. The handle link 420 is rotated about the handle link rotating shaft 422 as the door 300 is rotated.

The handle link 420 may include a horizontal member 425 extending rearward from the handle link rotating shaft 422. Thus, the handle link rotating shaft 422 may be formed at one end of the horizontal member 425. The handle link 420 may be rotatable relative to the handle link bracket 430 via the handle link rotating shaft 422.

The handle link 420 may include an extension member 421, which extends downward from the horizontal member 425 and then extends forward of the door 300.

The horizontal member 425 may extend rearward of the door 300 from the handle link rotating shaft 422 so as to be substantially parallel to the handle 410. In addition, the extension member 421 may extend downward from the horizontal member 425 and then extend forward of the door 300 so as to be connected at one end thereof to the handle 410.

The handle link 420 described above may be formed using a single member. However, in consideration of the fact that the opening/closing force of the door 300 as well as a vertical load may be applied to the handle link 420, the single handle link 420 may be formed by coupling a plurality of members to one another, in order to increase the strength of the handle link 420.

In some implementations, the horizontal member 425 may include the handle link rotating shaft 422 provided at one end thereof and a connecting portion 428 formed at the other end thereof. The horizontal member 425 may take the form of a single member.

The extension member 421 may be connected to the connecting portion 428. That is, the extension member 421 may extend downward from the connecting portion 428 and then extend forward of the door 300. Here, the extension member 421 may be formed of a single member, or may be formed by coupling a plurality of members to one another.

As illustrated in FIG. 4, the extension member 421 may include an inner extension member 427 and an outer extension member 426. The single extension member 421 may be formed by coupling the inner extension member 427 and the outer extension member 426 to each other. In addition, a handle coupling portion 427*a* may be formed on the inner extension member 427 or the outer extension member 426 such that the handle link 420 and the handle 410 are coupled to each other via the handle coupling portion 427*a*.

The horizontal member 425 is rotatably fixed to the handle link bracket 430. That is, the handle link rotating shaft 422 is rotatably fixed to the handle link bracket 430.

FIG. 5 illustrates an example handle link 420 when the door 300 is in a closed state. As the door 300 is opened, the handle link 420 is rotated in the counterclockwise direction about the handle link rotating shaft 422. Then, in the state in which the door 300 is completely opened (e.g. the state in which the door 300 is opened by substantially 90 degrees with respect to the floor surface), the horizontal member 425 of the handle link 420 may be vertically oriented, and a large portion of the extension member 421 is exposed out of the door 300.

This rotation of the handle link 420 is linked to the rotation of the door 300, and the link 440 may be provided to implement the rotation linkage. That is, the force required to rotate the handle link 420 is applied through the link 440.

To this end, the handle link 420 may include a link connecting portion 424. The link connecting portion 424 may be located between the handle link rotating shaft 422 and the connecting portion 428.

As illustrated in FIG. 5, the link 440 is connected to the link connecting portion 424. The link 440 may be rotatably connected to the link connecting portion 424. When the link 440 is pulled downward, the handle link 420 is rotated in the counterclockwise direction due to a moment distance between the link connecting portion 424 and the handle link rotating shaft 422. In contrast, the handle link 420 is rotated in the clockwise direction when the door 300 is closed.

The link 440 may extend downward from the link connecting portion 424 to thereby be connected to the damper rod 453. As such, the link connecting portion 424 is rotated about the link rotating shaft 451 as the door 300 is rotated. When the door 300 is rotated, the link 440 rotates the handle link 420 because the center of rotation of the door 300 differs from the center of rotation of the link 440.

The link connecting portion 424 is located between the rotating shaft 422 and the connecting portion 428 of the handle link 420. In practice, the link connecting portion 424 may be located higher than the rotating shaft 422. The link connecting portion 424 may be integrated with the rotating shaft 422 and the connecting portion 428 so as to form the horizontal member 425.

Owing to the position of the link connecting portion 424 described above, the handle link 420 may be formed with a perforation 429. The perforation 429 may be made in the center of the handle link 420. The link 440 may extend downward of the link connecting portion 424 through the perforation 429. The perforation 429 may be configured to provide the link 440 with sufficient front and rear margin regions so as to allow the link 440 to vary in position relative to the handle link 420. Owing to this position of the perforation 429, the distance maintenance members 480 may be provided respectively at both sides of the perforation 429.

Accordingly, the left-right width of the handle link 420 may be increased, which may increase the rigidity of the handle link 420. In addition, it is possible to prevent leftward and rightward shaking of the handle 410 or the handle link 420. This is because the single handle link 420 may be supported at the left and right sides of the perforation 429.

As described above, large force may be applied to the handle link 420 regardless of the rotation of the handle link 420. For example, when the handle 410 illustrated in FIG. 2 is pulled vertically upward, the door 300 and the handle link 420 are not rotated. This is because the door 300 is not rotated when the force is applied in the direction described above. This force is applied to the handle link 420.

The shape of the horizontal member 425 and the extension member 421 of the handle link 420 may cause deformation or damage to the handle link 420. In particular, since there is a distance between the handle link rotating shaft 422 and the extension member 421, deformation or damage to the handle link 420 may occur such that the distance between the handle link rotating shaft 422 and the extension member 421 is reduced.

Therefore, the distance maintenance members 480 may be provided in order to increase the strength of the handle link 420 and to more stabilize the handle link 420.

The distance maintenance members 480 may be located between the handle link 420 and the handle link rotating shaft 422 to maintain the distance between the handle link 420 and the handle link rotating shaft 422.

One end of each distance maintenance member 480 may be connected to the handle link 420. The other end of the distance maintenance member 480 may extend to the handle link rotating shaft 422.

As described above, the handle link 420 includes the extension member 421. The extension member 421 is positioned so as to be spaced apart from the handle link rotating shaft 422. As such, the distance maintenance members 480 may be provided between the handle link rotating shaft 422 and the extension member 421 so as to maintain the distance between the extension member 421 and the handle link rotating shaft 422. That is, the distance maintenance members 480 may support the extension member 421 to prevent the extension member 421 from being deformed in such a way that the distance between the handle link rotating shaft 422 and the extension member 421 is reduced.

As illustrated in FIG. 5, the distance maintenance members 480 may be vertically oriented when the door 300 is in a closed state. That is, the distance maintenance members 480 may be positioned to support the vertical upward force applied to the handle link 420 through the handle 410.

In some implementations, the radius of rotation of the extension member 421 relative to the handle link rotating shaft 422 is fixed through the horizontal member 425. However, since the horizontal member 425 extends substantially horizontally when the door 300 is in a closed state, the horizontal member 425 cannot support a vertical load applied to the handle link 420. Thus, the distance maintenance members 480, which are oriented substantially perpendicular to the horizontal member 425, may support the vertical load.

The distance maintenance members 480 may be fixed inside the handle link bracket 430. That is, the distance maintenance members 480 are fixed, and the handle link 420 is movable relative to the distance maintenance members 480. To this end, one end 481 of each distance maintenance member 480 may allow the sliding of the handle link 420. The other end 482 of the distance maintenance member 480 may allow the rotation of the handle link rotating shaft 422.

The end 481 of the distance maintenance member 480 may have an arc shape, and a rolling guide 423 may be formed at the extension member 421 of the handle link 420 so as to correspond to the arc-shaped end 481. The rolling guide 423 may have an arc shape such that the rolling guide 423 has a constant radius with respect to the handle link rotating shaft 422. As such, the end 481 of the distance maintenance member 480 may slide along the rolling guide 423 as the handle link 420 is rotated. That is, contact between the handle link 420 and the distance maintenance member 480, e.g. force transmission is maintained, thus enabling the rotation of the handle link 420.

The distance maintenance member 480 may serve to support the handle link 420 so as to maintain the shape of the handle link 420. That is, the distance maintenance member 480 may serve to maintain the radius of rotation of the handle link 420 with respect to the handle link rotating shaft 422. In this way, the distance maintenance member 480 may support the external force applied to the handle link 420 in the direction in which the radius of rotation of the handle link 420 is reduced.

In this way, through the provision of the distance maintenance members 480, it is possible to prevent damage to the handle link 420 and to ensure the more smooth rotation of the handle link 420.

As illustrated in FIGS. 3A AND 3B, the handle assembly 400 includes a screen 490. The screen 490 is located under the handle link 420. In some implementations, the screen 490 may be located so as to come into contact with the lower end of the handle link 420. In addition, the screen 490 may be moved upward or downward as the handle link 420 is rotated. That is, even if the handle link 420 is rotated, contact between the handle link 420 and the screen 490 may be maintained.

In some implementations, the screen 490 includes a screen body 491 configured to block the penetration hole 311. That is, even if a gap between the handle link 420 and the penetration hole 311 is generated, the screen body 491 blocks the gap. More specifically, the screen body 491 is located in the rear of the penetration hole 311, thereby preventing the user's hand from being inserted into the penetration hole 311.

The screen 490 may include a roller 492 in order to maintain smoother contact between the handle link 420 and the screen 490. The roller 492 may rotate in contact with the lower surface of the handle link 420. Accordingly, as the handle link 420 is rotated, the roller 492 may rotate in contact with the outer surface of the handle link 420.

Figure 6:
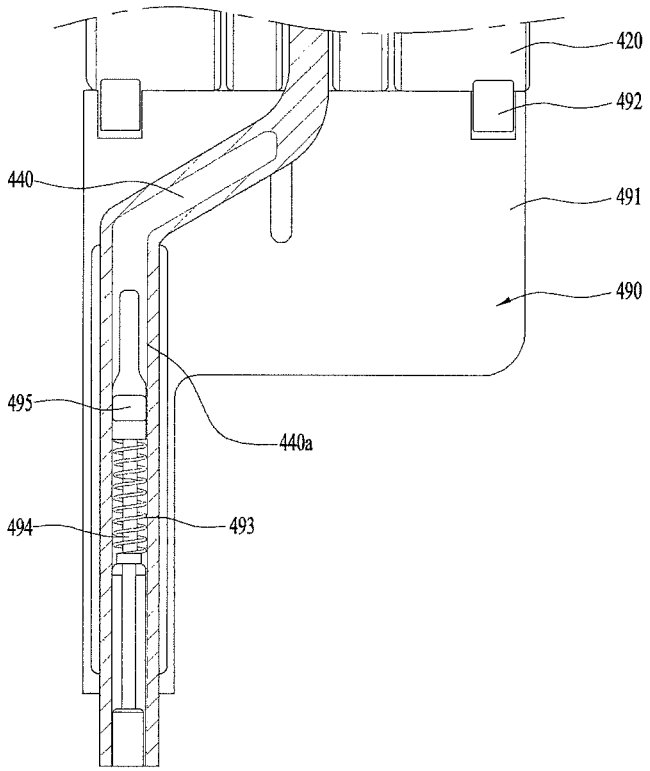
FIG. 6 is a partial front view of an example handle assembly, to which a screen is applied.

Hereinafter, the detailed configuration and operation of the screen 491 will be described in detail with reference to FIG. 6.

The screen 490 may include a screen elastic member 493. The screen body 491 may be moved upward or downward using displacement caused by the elastic deformation of the screen elastic member 493. For example, the screen elastic member 493 may be in a compressed state when the screen 490 is moved to the highest height. Thereafter, the elastic member 493 may be further compressed via the rotation of the handle link 420. That is, the screen body 491 is moved downward as the screen elastic member 493 is further elastically compressed.

In other words, the screen elastic member 493 always remains in an elastically compressed state. This means that elastic restoration force is continuously applied to the screen elastic member 493. The screen 490 always tends to move upward due to the elastic restoration force, and thus the contact between the screen 490 and the handle link 420 may be constantly maintained.

The screen elastic member 493 may be provided in the link 440. In some implementations, the link 440 has a slot 440*a* so that the elastic member 493 is elastically deformed in the slot 440*a*.

A guide lever 494 may be provided in the slot 440*a* in order to guide the elastic deformation of the elastic member 493. In addition, the screen 490 may include a pressure member 495. The pressure member 495 may be brought into contact with the screen elastic member 493 so as to apply pressure to the screen elastic member 493.

The pressure member 495 is moved upward or downward in the same manner as the screen body 491. That is, as the screen body 491 is moved upward or downward, the displacement of the screen elastic member 493 caused by the pressure member 495 varies.

In conclusion, the screen 490 may be linearly reciprocally moved along the link 440 while being elastically supported by the link 440.

The screen 490 described above blocks the gap between the penetration hole 311 and the handle link 420 via the elastic deformation of the screen elastic member 493 while being located behind the penetration hole 311. Accordingly, when the user's hand is inserted into the penetration hole 311, the screen 490 blocks the user's hand, thereby preventing the user's hand from being inserted deeper into the penetration hole 311. That is, an opening, into which the user's hand may be inserted, is blocked by the screen 490. In this way, it is possible to prevent the user's hand from becoming jammed in the penetration hole 311 when the rotation of the door 300 and the rotation of the handle link 420 are linked to each other.

In some implementations, the screen 490 may prevent the user's hand from becoming jammed in the penetration hole 311, or from becoming jammed between the handle link 420 and the front surface of the door 300.

Hereinafter, an implementations for preventing a jammed user's hand from being further tightly jammed will be described. That is, an implementations for minimizing the force or shock applied to the user's hand in the state in which the user's hand is partially jammed will be described. The present implementations may be implemented independently of the above-described implementations of the screen, and or course, may be implemented simultaneously with the above-described implementation of the screen.

In some implementations, the length of the link 440 does not vary. Assuming that the link 440 is a rigid body, the rotation of the door 300 may be directly transmitted to the handle link 420. That is, from a mechanical aspect, the rotation of the door 300 is directly transmitted to the handle link 420 via the link 440.

For example, the door 300 may be closed further in the state in which the user's hand is jammed in the penetration hole 311. That is, the handle link 420 is further rotated by the same angle as the angle by which the door 300 is closed further. At this time, larger force or shock is applied to the user's hand. That is, the user's hand may be more seriously injured when the user carelessly further closes the door 300 in the state in which the user's hand is jammed. This is because the rotation of the door 300 is directly transmitted to the rotation of the handle link 420, assuming that the link 440 is a rigid body as described above. In addition, this is because the gap between the handle link 420 and the penetration hole 311 is reduced as the door 300 is closed. The reduction in the gap may cause more serious damage to the user's hand.

A home appliance may have a link, the length of which is variable in order to allow the rotation of the door 300 in the state in which the rotation of the handle link 420 is restrained. The rotation of the handle link 420 may be restrained for any reason. Of course, the greatest reason is a foreign object interposed between the penetration hole 311 and the handle link 420. The foreign object may be the user's hand.

Similar to the rigid link 440, the length of the link may not be variable in the normal state in which the rotation of the handle link 420 is not restrained. In this case, the rotation of the door 300 may be substantially converted into the rotation of the handle link 420.

Hereinafter, the home appliance having a length variable link will be described with reference to FIG. 7.

As illustrated in FIG. 7, the overall configuration of the handle assembly is the same as or similar to that of the above-described implementation.

In some implementations, the length of the link 440 may be variable. That is, although the length of the link 440 does not vary in the normal state, as described above, the length of the link 440 may be varied in order to allow the rotation of the door 300 in the state in which the rotation of the handle link 420 is restrained.

To this end, the link 440 may include a link elastic member 441, which is elastically deformed in the longitudinal direction. Slight compressive or tensile force may be applied to the link elastic member 441 while the door 300 is opened or closed. However, variation in the length of the link 440 is very slight in the normal state because the link elastic member 441 may have sufficient rigidity.

However, when the rotation of any one of the door 300 and the handle link 420 is restrained, the link elastic member 441 may be elastically deformed to a length sufficient to allow the rotation of the other one of the door 300 and the handle link 420.

In some implementations, the link 440 may include the link elastic member 441 and a guide rod 442 for guiding the elastic deformation of the link elastic member 441. The link elastic member 441 may be configured so as to surround the guide rod 442.

More specifically, the link elastic member 441 may be provided between a link rod of the link 440, which is connected to the handle link 420, and the damper rod 453. That is, the link elastic member 441 may be provided so that the distance between the link 440 and the damper rod 453 is variable. When the link elastic member 441 is deformed to increase the distance between the link 440 and the damper rod 453, this may be referred to as an increase in the length of the link 440.

When the abnormal state described above, e.g. the hand jam state is released, the link 440 may return to the normal state thereof. This means that the link elastic member 441 is elastically restored when the force applied to the link elastic member 441 is removed.

Figure 8:
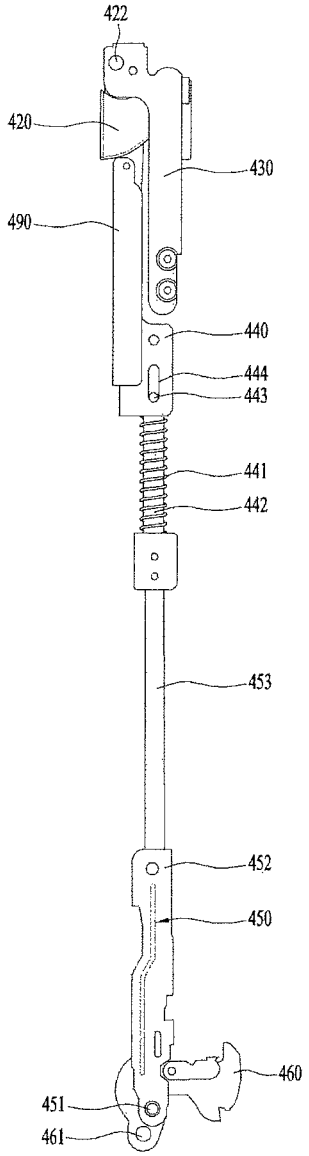
FIGS. 8 to 10 are side views of example handle assemblies when a door is closed or opened.
Figure 9:
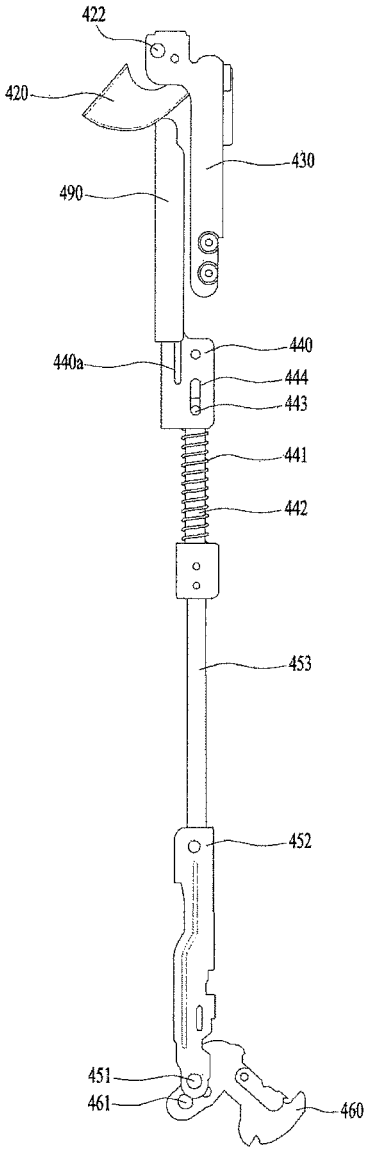
Figure 10:
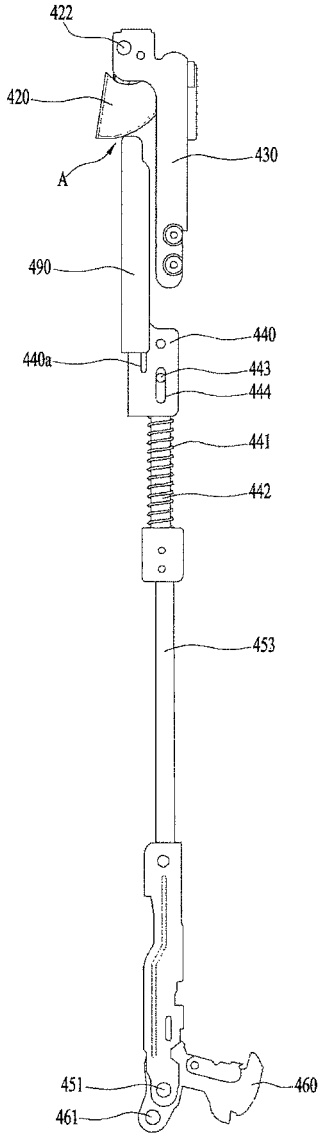

Hereinafter, a mechanism for preventing hand jamming using the link elastic member 441 will be described in detail with reference to FIGS. 8 to 10. FIGS. 8 to 10 illustrate an implementation in which the screen 490 is combined.

FIG. 8 illustrates an example handle assembly in the closed state of the door 300. That is, FIG. 8 is a side view illustrating the handle assembly located in the space inside the door 300.

FIG. 9 illustrates an example state after the door 300 is opened in the state illustrated in FIG. 8. For convenience of description, although some components, such as the link 440, are illustrated as being vertically oriented, it can be appreciated that the door 300 is rotated by 45 degrees or more in FIG. 9, considering the angle between the link 440 and the hinge 460.

When the door 300 is rotated, the handle link 420 is rotated. At this time, it can be appreciated that the screen 490 is moved upward. That is, it can be appreciated that the screen 490 remains in close contact with the handle link 420. This may substantially mean that the screen 490 is moved upward relative to the link 440. That is, the screen 490 may substantially be moved upward by the same length as the slot 440*a* illustrated in FIG. 9. In addition, as illustrated in FIG. 10, it can be appreciated that the screen 490 is moved downward along the slot 440*a* as the door 300 is closed.

It can be appreciated that the close contact relationship between the screen 490 and the handle link 420 may prevent the user's hand from becoming jammed. That is, it can be appreciated that it is possible to prevent the user's hand from becoming jammed in region "A" illustrated in FIG. 10.

As illustrated in FIGS. 8 and 9, in the normal state, the length of the link 440 may not vary. The abnormal state in which the user's hand is jammed may frequently occur immediately before the door 300 is closed, and the hand jamming occurring at this time may cause serious injury. That is, when the user's hand is jammed immediately before the door 300 is closed as illustrated in FIG. 10, it may be necessary to limit the linkage between the door 300 and the handle link 420. That is, the door 300 may be rotated and closed even if the rotation of the handle link 420 is restrained.

As illustrated in FIG. 10, when the user's hand is jammed in the region "A", the rotation of the handle link 420 is restrained. In the state in which the rotation of the handle link 420 is restrained, the link 440 may allow the door 300 to be rotated to the state illustrated in FIG. 8. That is, the link 440 may be positioned to allow the door 300 to be completely closed.

In other words, the length of the link 440 may be varied by elastic deformation of the link 440 in the state in which the rotation of the handle link 420 is restrained, whereby the link 440 may allow the door 300 to be substantially completely closed as illustrated in FIG. 8.

The elastic deformation of the link 440 is implemented by the deformation of the link elastic member 441. In order to facilitate the elastic deformation, the link 440 has a slot 444, and the elastic deformation of the link elastic member 441 may be permitted by the length of the slot 444.

As described above, the guide rod 442 is formed in order to guide the elastic deformation. The guide rod 442 may include a pin 443 for sliding in the slot 444. The pin 443 may always be located at the lower end of the slot 444 in the normal state. This state may be referred to as the state in which the link elastic member 441 is not elastically deformed.

The pin 443 moves to the upper end of the slot 444 as the door 300 is further rotated in the closing direction in an abnormal state (e.g. the state in which the rotation of the handle link 420 is restrained). This state may be referred to as the state in which the link elastic member 441 is elastically deformed so as to be increased in length.

One end of the link elastic member 441 is connected to the damper rod 453 and the other end of the link elastic member 441 is connected to the pin 443, whereby the length of the link elastic member 441 is increased in the abnormal state.

Accordingly, even if the door 300 is closed further in the state in which the user's hand is jammed, it is possible to prevent greater force from being applied to the user's hand.

From a mechanical aspect, a large force may be applied to the handle 410 and the front surface of the door 300 when the door 300 is completely closed. That is, when the door 300 is rapidly closed, a large force may be applied to the handle 410 and the front surface of the door 300. Thus, a large force is applied to the user's hand when the user's hand is in the jammed state. The link elastic member 441 described above may prevent this force.

Figure 11:
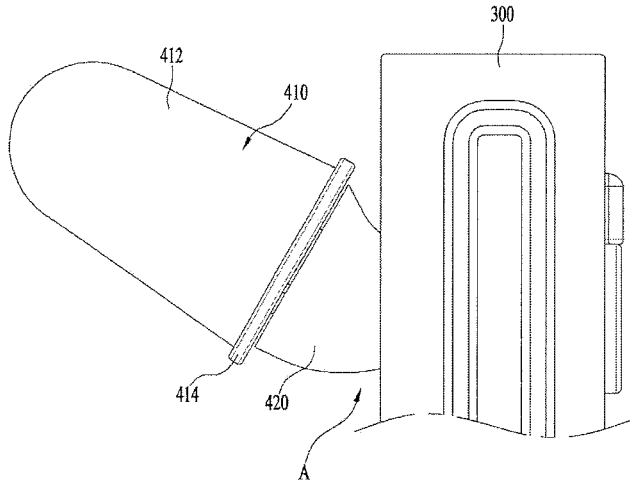
FIG. 11 is an enlarged side view of an example gap between a handle and a door.

The handle support portion 412 may be provided with a decoration portion 414 in order to reduce the force applied to the user's hand. That is, the decoration portion 414, which has a larger cross-sectional area than the cross-sectional area of the penetration hole 311, may be formed. In addition, the cross-sectional area of the decoration portion 414 may correspond to that of the largest portion of the handle support portion 412. As illustrated in FIG. 11, the cross-sectional area of the handle support portion 412 may gradually increase and then rapidly increase at the decoration portion 414.

Considering the situation in which the user's hand is jammed, the situation may be the case where the user's hand grips the handle grip portion 411 while being located in maximally close contact with the handle support portion 412. For example, a portion of the user's little finger is jammed in the region "A" illustrated in FIG. 11.

In consideration of the case described above, the decoration portion 414 may cause a portion of the user's little finger to be caught therein, thus preventing the user's hand from becoming jammed.

A rubber pad 415 may be mounted on the decoration portion 414. That is, the rubber pad 415 may be mounted on the surface of the decoration portion 414 facing the penetration hole 311. The rubber pad 415 functions to alleviate shock between the handle support portion 412 and the door 300.

In addition, in consideration of the region "A" in which the user's hand is jammed, the bottom contour of the rubber pad 415 may coincide with the bottom contour of the decoration portion 414. In some implementations, the lower end of the decoration portion 414 and the lower end of the rubber pad 415 may coincide with each other. In other words, when the user's hand is jammed in the region "A", it may be desirable to allow the user's hand to come into contact with the rubber pad 415, rather than the decoration portion 414. Accordingly, because the user's hand comes into contact with the rubber pad 415 in the abnormal state, it is possible to minimize injury.

The injury resulting from the user's hand jamming as described above may be the worst immediately before the door 300 is closed. That is, this is because the largest force is applied to the user's hand at this time. Therefore, it may be desirable to increase the time taken to close the door 300. That is, it may be necessary to cause the door 300 to close slowly immediately before the door 300 is completely closed.

Figure 13:
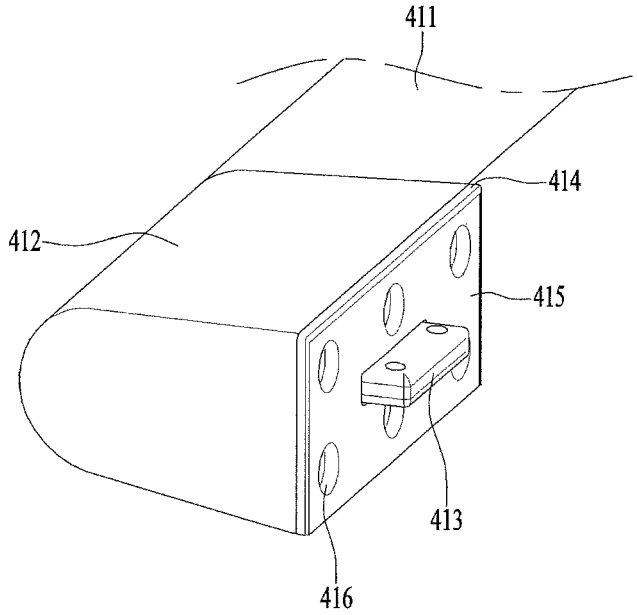
FIG. 13 is a partial perspective view of an example handle support member.

As illustrated in FIG. 13, the handle support portion 412 includes a coupling piece 413 for coupling with the handle link 420. The coupling piece 413 may be coupled to the handle coupling portion 427*a* formed in the handle link 420. The handle support portion 412 may be coupled to the handle link 420 using, for example, a screw.

In the state in which the door 300 is completely closed, the handle support portion 412 may come into close contact with the front surface of the door 300. To this end, the rubber pad 415 may be formed as described above. In addition, a hole 416 may be formed in the rubber pad 415.

When the rubber pad 415 comes into close contact with the front surface of the door 300, air inside the hole 416 may be discharged outward. Thus, force for causing the rubber pad 415 to come into close contact with the front surface of the door 300 is generated due to a negative pressure inside the hole 416. Accordingly, the handle support portion 412 may come into close contact with the front surface of the door 300 in the completely closed state of the door 300.

Figure 12:
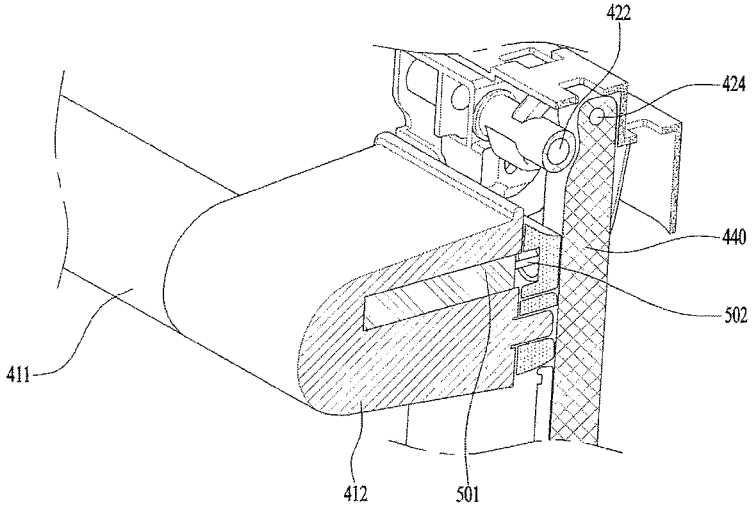
FIG. 12 is a partial sectional view of an example handle assembly, to which a damper is applied.

To this end, a damper structure may be applied as illustrated in FIG. 12.

In some implementations, a damper structure 501 and 502 may be provided between the handle support portion 412 and the link 440.

A damper housing 501 may be provided inside the handle support portion 412, and a damper shaft 502 may be provided between the damper housing 501 and the link 440. The damper housing 501 and the damper shaft 502 have a substantially linear relationship immediately before the door 300 is substantially closed. For example, it may be assumed that the damper shaft 502 and the damper housing 501 have a substantially linear relationship starting from an angle of 15 degrees before the door 300 is completely closed until the door 300 is completely closed. That is, due to the linear relationship within the angle, a repulsive force resisting the rapid closing of the door 300 may be generated between the damper shaft 502 and the damper housing 501. Accordingly, the resulting damping force may delay the rotation of the handle 410, thus reducing the force that is applied when the user's hand is jammed, and preventing damage to the user's hand.

A home appliance may have a handle assembly that may limit the linkage between a door and a handle when the rotation of the door and the handle is restrained.

A home appliance may have a handle assembly that may prevent damage to the user's hand that occurs when a door is closed in the state in which the user's hand is jammed between the door and a handle.

A home appliance may have a handle assembly that may prevent the user's hand from becoming jammed between a door and a handle.

A home appliance may have a handle assembly that may allow a handle to smoothly return to the correct position when a door is closed.

A home appliance may have a handle assembly that may implement the linkage between rotation of a door and rotation of a handle, thereby achieving convenience of use and increased safety.

What is claimed is:

1. A home appliance comprising:

a cabinet that defines a chamber that is configured to receive an object;

a door that is located at a front side of the cabinet, that is configured to open or close the chamber by rotating about a door rotating shaft, and that defines a penetration hole that is located in a front surface of the door;

a handle that is located on the front surface of the door and that is configured to be gripped by a user during opening or closing the door;

a handle link that is configured to rotate about a handle link rotating shaft that is located inside the door, wherein a portion of the handle link is exposed outside the door through the penetration hole and a length of the portion of the handle link varies based on an opening angle of the door; and a link that is configured to convert a rotation motion of the door into a rotation of the handle link, that is configured to guide rotation of the door based on the rotation of the handle link being restrained by having a variable length based on a user's hand being located between the handle link and a front surface of the door, that includes a link rod that is connected to the handle link and includes a damper rod that is rotatably connected to the link rotating shaft, and that includes a link elastic member (i) that is configured to guide rotation of the door by a length that the elastic member is configured to extend based on rotation of the handle link being restrained and (ii) that is located between the link rod and the damper rod.

2. The home appliance according to claim 1, wherein:

the link is configured to rotate about a link rotating shaft based on the door rotating, and the link rotating shaft is located eccentrically to the door rotating shaft.

3. The home appliance according to claim 2, wherein an end of the link is rotatably connected to the handle link.

4. The home appliance according to claim 1, further comprising a screen that is located inside the penetration hole and that is configured to move upward or downward while being in contact with the handle link during rotation of the handle link.

5. The home appliance according to claim 4, wherein the link is configured to elastically support the screen.

6. The home appliance according to claim 4, wherein the screen includes:

a screen body that is configured to cover a gap between the penetration hole and the handle link;

a roller that is configured to contact a lower surface of the handle link on a top of the screen body by rotating; and a screen elastic member that is configured to elastically support the screen body from the link.

7. The home appliance according to claim 1, wherein the handle includes:

a handle grip portion that extends in a left-right direction and that is spaced apart from the front surface of the door; and a handle support portion that extends from opposite ends of the handle grip portion toward the door, wherein the handle support portion and the handle link are coupled to each other.

8. The home appliance according to claim 7, wherein a damper is located between the handle support portion and the link.

9. The home appliance according to claim 8, wherein the damper includes:

a damper housing, wherein the handle support portion is configured to receive the damper housing; and a damper shaft that extends from the damper housing, wherein the link is configured to support the damper shaft.

10. The home appliance according to claim 7, wherein the handle support portion includes a decoration portion that is configured to contact the door and that includes a rubber pad.

11. The home appliance according to claim 10, wherein the rubber pad includes a lower end that is coupled to a lower end of the decoration portion.

12. A home appliance comprising:

a cabinet that defines a chamber that is configured to receive an object;

a door that is configured to open or close the chamber by rotating about a door rotating shaft and that defines a penetration hole that is located in a front surface of the door;

a handle that is located on the front surface of the door, that is configured to be gripped by a user during opening or closing the door, and that includes:

a handle grip portion that extends in a left-right direction and that is spaced apart from the front surface of the door; and a handle support portion that extends from opposite ends of the handle grip portion toward the door, wherein the handle support portion and the handle link are coupled to each other;

a handle link that is configured to rotate about a handle link rotating shaft that is located inside the door, wherein a portion of the handle link is exposed outside the door through the penetration hole and a length of the portion of the handle link varies based on an opening angle of the door;

a link that is configured to convert a rotation motion of the door into a rotation motion of the handle link and that includes a link elastic member that is configured to stretch in a direction in which the rotation motion of the door or the rotation motion of the handle link is limited based on the rotation motion of the door or the rotation motion of the handle link being stationary; and a damper that is located between the handle support portion and the link and that includes:

a damper housing, wherein the handle support portion is configured to receive the damper housing; and a damper shaft that extends from the damper housing, wherein the link is configured to support the damper shaft.

13. The home appliance according to claim 12, wherein a length of the link is variable based on the elastic member being configured to stretch in a longitudinal direction of the elastic member.

14. A home appliance comprising:

a cabinet that defines a chamber that is configured to receive an object;

a door that is configured to open or close the chamber by rotating about a door rotating shaft and that defines a penetration hole that is located in a front surface of the door;

a handle that is located on the front surface of the door and that is configured to be gripped by a user during opening or closing the door;

a handle link that is configured to rotate about a handle link rotating shaft that is located inside the door, wherein a portion of the handle link is exposed outside the door through the penetration hole and a length of the portion of the handle link varies based on an opening angle of the door;

a link that is configured to convert a rotation motion of the door into a rotation motion of the handle link; and a screen that is located inside the penetration hole, that is configured to move upward or downward while being in contact with the handle link during rotation of the handle link, and that includes:

a screen body that is configured to cover a gap between the penetration hole and the handle link;

a roller that is configured to contact a lower surface of the handle link on a top of the screen body by rotating; and a screen elastic member that is configured to elastically support the screen body from the link.

15. The home appliance according to claim 14, wherein the screen is configured to contact a lower portion of the handle link.

16. The home appliance according to claim 15, wherein the screen is configured to block a gap defined by the penetration hole and the handle link based on the screen moving up or down in response to rotation of the handle, wherein a size of the gap varies as the handle link rotates.

* * * * *